US005823076A

United States Patent [19]

Binkowski

[11] Patent Number: 5,823,076

[45] Date of Patent: Oct. 20, 1998

[54] ADJUSTABLE, RATCHETING GEAR WRENCH FOR PIPES AND BOLTS

[76] Inventor: Kazimierz M. Binkowski, 17 Riggs St., Ansonia, Conn. 06401

[21] Appl. No.: 648,782

[22] Filed: May 16, 1996

[51] Int. Cl.[6] ..... D25B 13/14

[52] U.S. Cl. ..... 81/127; 81/129.5; 81/423

[58] Field of Search ..... 81/126, 127, 128, 81/129.5, 150, 58, 421–423

[56] References Cited

U.S. PATENT DOCUMENTS

| | | | |
|---|---|---|---|
| 708,210 | 9/1902 | Dahl | 81/126 |
| 844,176 | 2/1907 | McOsker | 81/126 |
| 1,847,959 | 3/1932 | Harris | 81/127 |

*Primary Examiner*—D. S. Meislin
*Attorney, Agent, or Firm*—M. P. Williams

[57] ABSTRACT

A gear wrench includes a lever 10 having a handle 11 at a distal end and a sector pinion gear 13 at a proximal end, rotatable in a cavity 26 of a fixed jaw body 18 by means of a pivot 14. The teeth of the pinion engage the teeth of a rack 21 disposed on a sliding jaw 25 so that rotation thereof adjusts the working size of the wrench. The pivot 14 is tangential to the sliding surface 85 of the sliding jaw thereby to ensure gripping pressure and turning of an object as small as the wrench is designed for. A spacer 27 causes the teeth of the rack to engage the pinion unless it is displaced to allow the rack to withdraw to the rear of the pinion, thereby to adjust the relative positioning of the sliding jaw and the fixed jaw. Gripping surface inserts 51, 52 have threads 59, 66 on one side for pipes, and are smooth on the other side for fittings, nuts and bolts; the inserts are held in place by thumb screws 53, 54 and stabilized by tabs 60, 61, 70, 71. A spring 46 between the fixed and sliding jaw provides ratcheting action.

15 Claims, 3 Drawing Sheets

ADJUSTABLE, RATCHETING GEAR WRENCH FOR PIPES AND BOLTS

TECHNICAL FIELD

This invention relates to a wrench which uses a rack and handle-operated pinion gear to grip a pipe or a bolt, nut, or fitting, can be adjusted to different gross sizes by adjusting the relative position of the pinion and the rack, and has a ratcheting action.

BACKGROUND ART

A gear operated wrench is shown in U.S. Pat. No. 2,765,691. The gear is disposed at the proximal end of the handle which is pivoted in the fixed jaw of the wrench. The beak, or moving jaw of the wrench is slidable within the fixed jaw in response to teeth of the gear acting against pins in the sliding jaw. That wrench has three significant problems: it is cumbersome to readjust the position (that is, it does not ratchet well), it is useful only on pipes, and not nuts, bolts or other flat surfaces, and, regardless of how close together the two jaws are brought with pressure, it will not grip objects below a certain size: that is, even though the jaws may close sufficiently to operate on a certain size piece, in fact the wrench will not grip pieces of that size sufficiently to turn the same to or from a tightened condition.

DISCLOSURE OF INVENTION

Objects of the invention are to provide an improved wrench which is truly adjustable, which can work on fittings, nuts and bolts as well as on pipes, which will provide a firm grip on any objects its jaws engage, and which has a smooth ratcheting capability to assist in acquiring successive purchases of the object being turned.

The invention is based on two discoveries, which have a relationship between them. The first discovery is that a gear wrench cannot properly grip and turn any object about an axis which is closer to the root of the jaw than is the pivot of the wrench. In other words, if a small object is being worked by the gear wrench, it can only be turned if gripped at the outer edge of the jaws, not at the root of the jaws, rendering operation extremely difficult, and ratcheting impossible. Because of this factor, the use of pins aggravates the problem since the pins must be set within metal which increases the inherent distance between the point of application of pressure on the pins and the pivot of the gear. The invention is further based on the realization that the gross adjustability of a wrench, so as to go from one size to another, cannot be based simply upon the gear operation thereof unless the wrench is useful for an extremely small range of sizes or the gear is quite large, meaning that its pivot point will be a great distance from the root of the jaws, creating a problem with small objects, as described hereinbefore.

According to the present invention, a gear wrench comprises a pinion gear formed in the proximal end of the wrench handle, pivoted to the fixed jaw of the wrench, with its teeth engaging a rack disposed on the beak or sliding jaw of the wrench, the pivot of the gear being disposed tangentially with the sliding surface of the sliding jaw, that is so the pivot is essentially in line with the root of the jaw.

According to the invention further, gross adjustability of a gear wrench is provided by means of a moveable spacer or distance plate, which, when in place causes the pinion to be engaged with the rack, but when displaced, it allows the pinion and rack to disengage from each other, whereby the relative positioning of the pinion and the rack may be adjusted. In accordance further with the invention, the distance plate or spacer may be kept in place, with the wrench operable, by suitable means such as a clip or a spring loaded ball and detent.

In accordance with the invention, a gear wrench has reversible jaw inserts which may provide teeth for engaging pipes, and smooth gripping surfaces for fittings, nuts, bolts and the like; the jaw insert on the sliding jaw is stabilized against outward forces by means of tabs on the insert which rest behind tabs on the sliding jaw. In accordance with the invention in one form, the jaws are held in place or removed for reversal by thumb screws.

In accord with the invention, the sliding jaw is resiliently urged about the tangential pivot in a direction to tend to bring the gripping surfaces of the jaws closer together. This results in the capability to rock the wrench, in a ratcheting action, when working pipes or fittings, bolts, or nuts.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
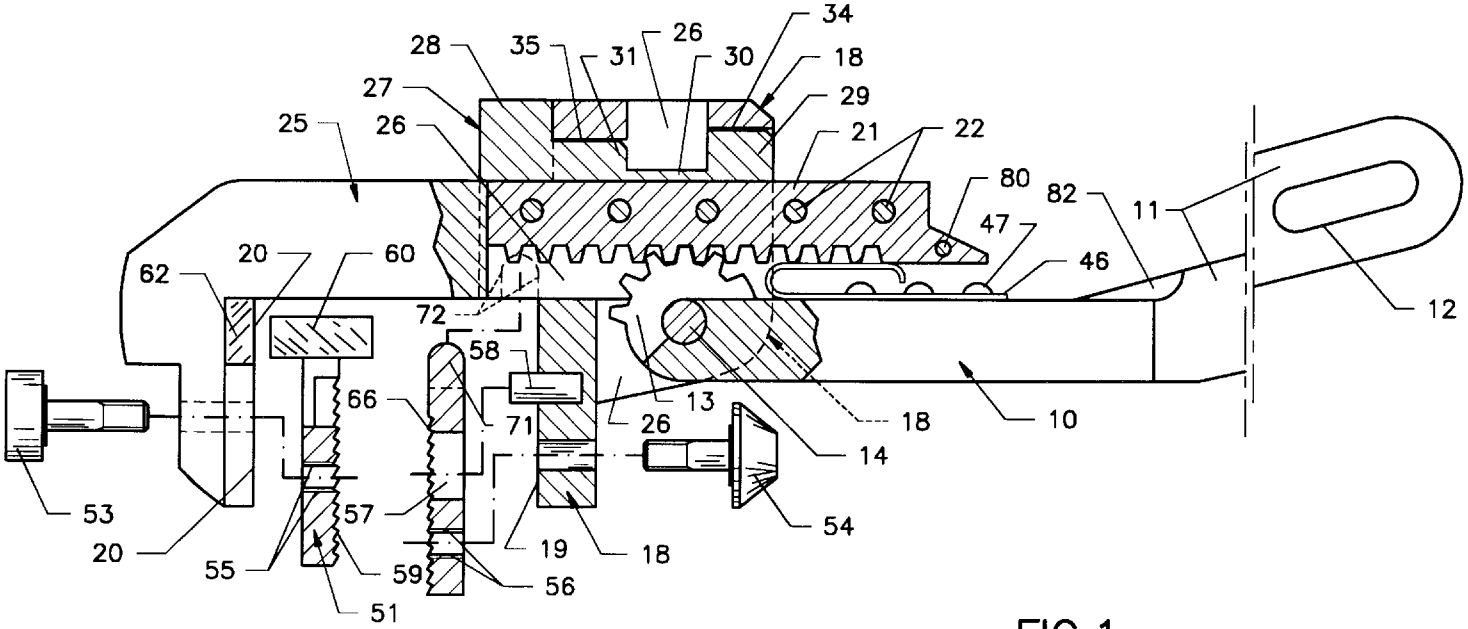
FIG. 1 is a partially exploded, partially broken away and sectioned side elevation view of a wrench according to the present invention.
Figure 2:
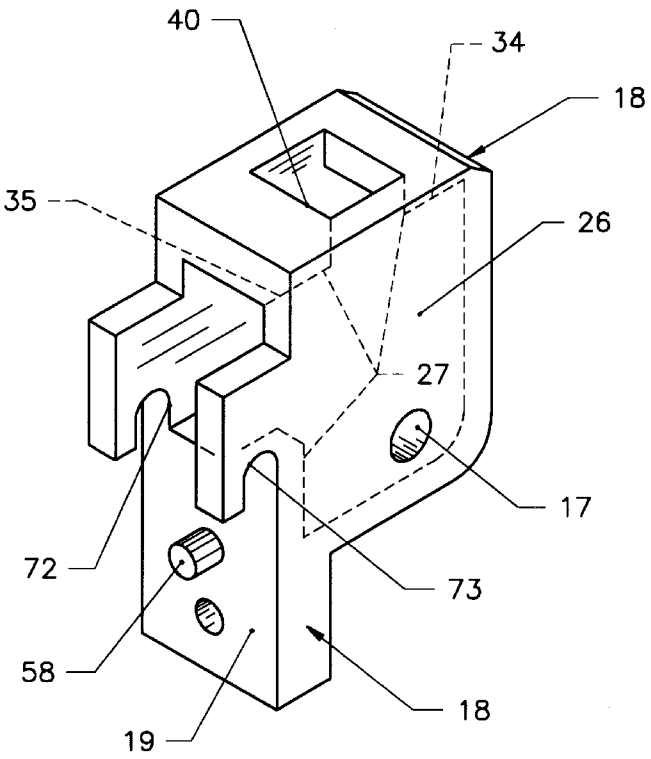
FIG. 2 is a perspective view of the fixed jaw body of the wrench of FIG. 1.

Referring now to FIG. 1, a wrench according to the invention has a lever 10 with a handle 11 having a hole 12 at its distal end and a segment of a pinion gear 13 in its proximal end. A pivot 14 is disposed through a hole which is coaxial with the teeth of the pinion 13 for pivoting the handle 11 within a hole 17 (FIG. 2) with a fixed jaw body 18 having a first jaw surface 19 on a jaw portion thereof. The teeth of the pinion 13 mesh with the teeth of a rack 21 which is secured, such as by press fit pins 22, between bifurcated legs 23, 24 of a sliding jaw 25 having a second jaw surface 20, generally facing said first jaw surface. Rotation of the handle 11 and lever 10 will rotate the pinion 13 thereby sliding the rack 21, and therefore the sliding jaw 25 to the right or the left as seen in FIG. 1, whereby the wrench derives its fine adjustability and its ability to apply intense pressure through the gripping surfaces. The sliding jaw 25 slides within a cavity 26 within the fixed jaw body 18; in FIG. 2, the outline of the cavity 26 is traced on the inside of the near wall by the dotted lines 27.

Figure 3:
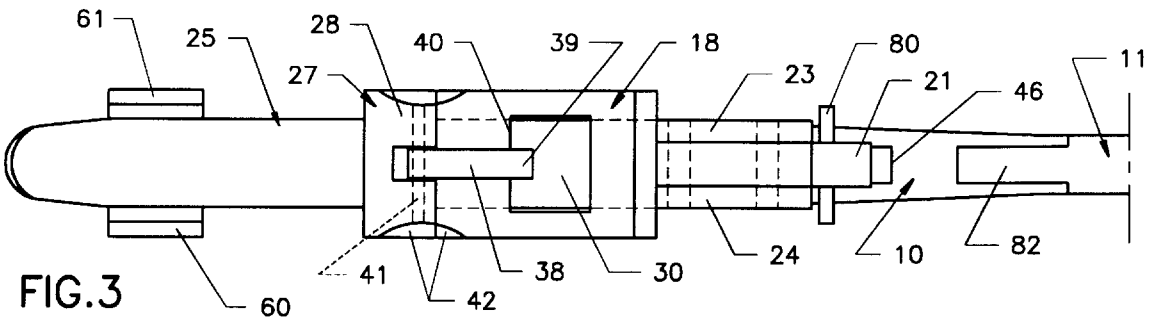
FIG. 3 is a top plan view of the wrench of FIG. 1.
Figure 7:
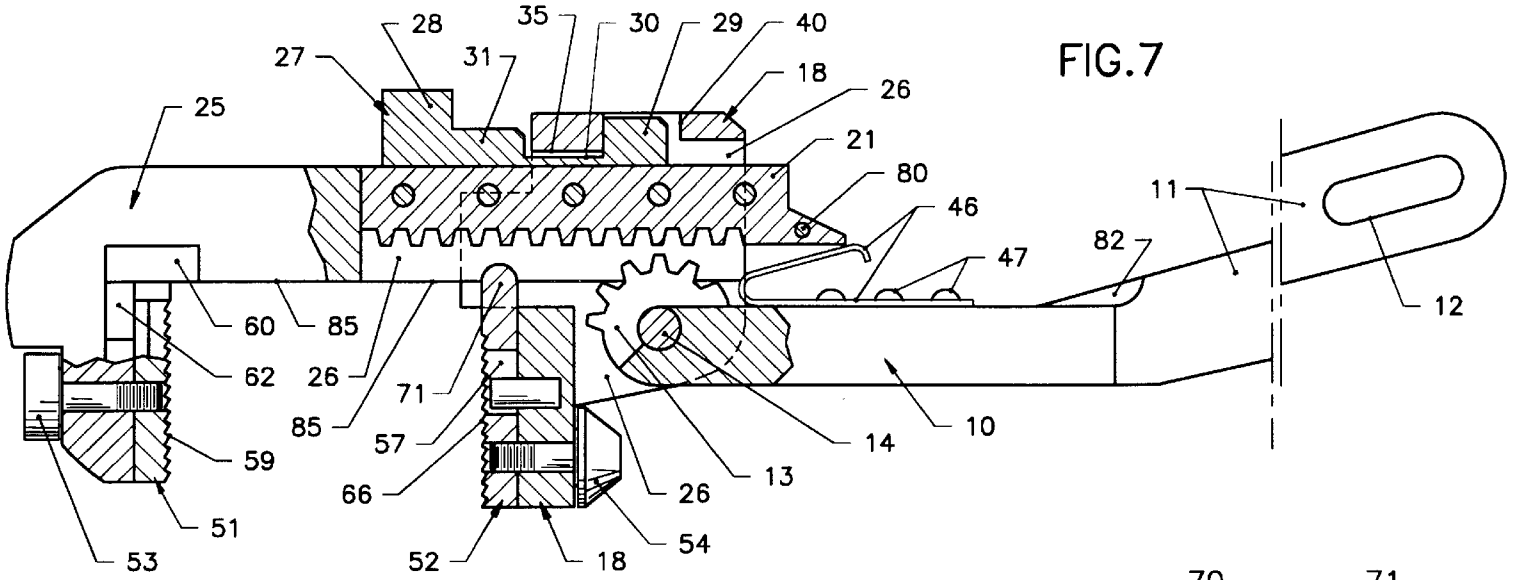
FIG. 7 is a partially exploded, partially broken away and sectioned side elevation view of the wrench of FIG. 1 with the spacer or distance plate displaced so as to permit the teeth of the rack to disengage from the pinion, thereby to allow adjustment of the working size of the wrench.
Figure 4:
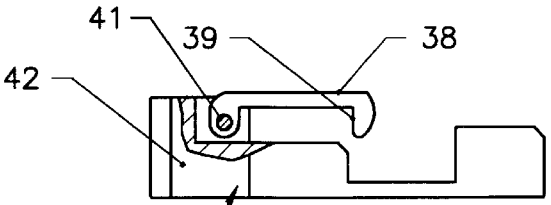
FIG. 4 is a partially broken away and sectioned side elevation view of a spacer or distance plate for use in the wrench of FIG. 1.

As seen in FIG. 1, the sliding jaw 25 is held in working position with the rack 21 engaging the pinion 13 by means of a distance plate or spacer 27 which has a handle portion 28, a tall plateau portion 29, a short plateau portion 30 and a medium plateau portion 31. The tall plateau portion 29 butts against a rear surface 34 on a rear portion of the fixed jaw body 18 and the medium plateau portion 31 butts against a rear surface 35 of said rear portion when the spacer 27 is inserted into its working position as shown in FIG. 1. Not shown in FIG. 1, but illustrated in FIGS. 3 and 4, the spacer 27 may be held in the position shown in FIG. 1 by means of a catch 38 which has a hook portion 39 that can engage an edge of a hole 40 in the fixed jaw body 18. The catch 38 may be pivoted to the handle portion 28 of the spacer 27 by means of a pin 41. If desired, the handle portion 28 and the adjoining portion of the fixed jaw piece 18 may be cupped out, as at 42, to provide a better finger grip for the purpose of sliding the spacer 27 to the right or left. When the catch 38 is released and the spacer 27 is pulled to the left as seen in FIG. 7, the tall plateau 29 and medium plateau 31 are no longer in contact with the fixed jaw body 18, the tall plateau portion 29 extending into the hole 40. This means that the position of the rack 21 is defined by the low plateau 30 adjacent to the surface 35. As is seen in FIG. 7, this allows the pinion 13 to disengage from the rack 21 so that the sliding jaw 25 can be moved to the right or the left thereby changing the working size of the wrench. In FIG. 7, the sliding jaw has been moved to the left compared with its position in FIG. 1, thereby causing the working size of the wrench to be larger than it is in FIG. 1. Once the sliding jaw 25 is in a desired position, so as to loosely engage a pipe, a fitting, a bolt or a nut, it can then be urged toward the pinion 13 and the spacer 27 can once again be moved to the right as seen in FIG. 1 so as to resume the working position, and the catch 38 may be engaged. Instead of the catch 38, a spring loaded ball catch may be provided at one of the surfaces 34, 35 so as to engage a detent in one of the plateaus 29, 31, or some other suitable accommodation may be made.

To assist in ratcheting action, as the handle may be rotated clockwise and then counterclockwise, repetitively, to effect each new purchase of the part being turned, a flat spring 46 may be secured to the lever 10 such as with self-tapping screws 47 or the like.

Figure 6:
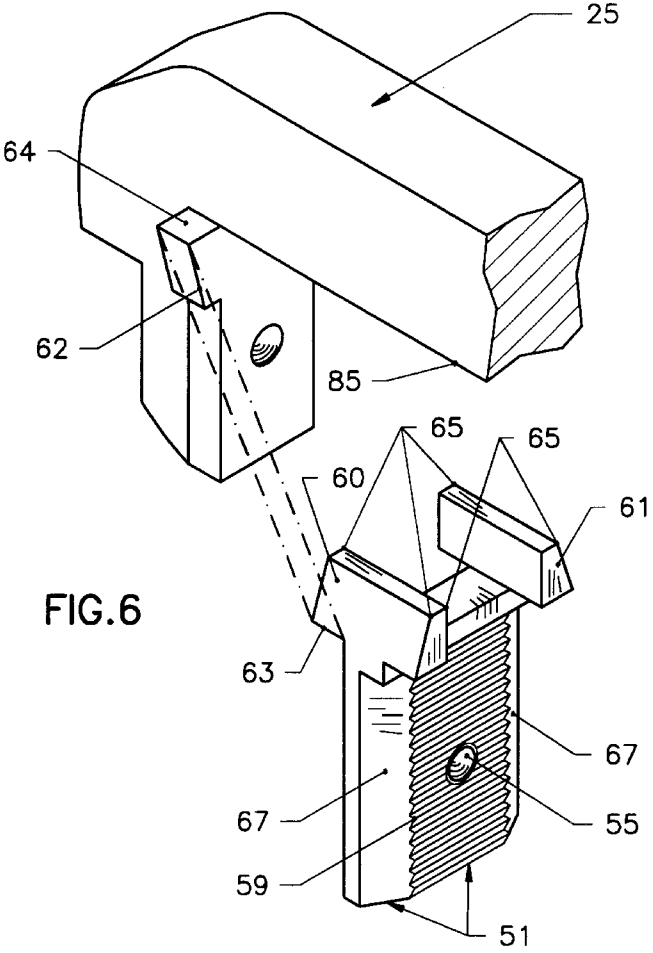
FIG. 6 is a perspective view of a portion of a moveable jaw and its gripping surface insert.

The invention as it is described thus far may be utilized with conventional fixed jaws, or it may be utilized with reversible gripping surface inserts 51, 52 which can be secured to the sliding jaw 25 and fixed jaw body 18, respectively, by thumb screws 53, 54 which mate with related threaded holes 55, 56. To stabilize the position of the insert 52, a slot 57 engages a pin 58 in the fixed jaw body 18. However, stabilizing the insert 51 is far more complex because there is a strong, outward force exerted on the teeth 59 of the insert 51 as a result of clockwise torque on the handle 11 when applying pressure to a pipe. To counteract this force, the insert 51 has tabs 60, 61 (FIG. 6) which cradle the sliding jaw 25 and rest behind corresponding tabs on the sliding jaw, only one tab 62 being shown. The surface 63 imparts the outward force to the surface 64, as shown by the dotted lines in FIG. 6, and similarly with respect to the other tabs. The corners 65 of the tabs 60, 61 may be rounded to provide a smooth feel to the user when in use; or the tabs 60, 61 may be semicircular, thus eliminating the corners 65 altogether. The tab 62 (and one like it) may be tapered or rounded, if desired.

Figure 5:
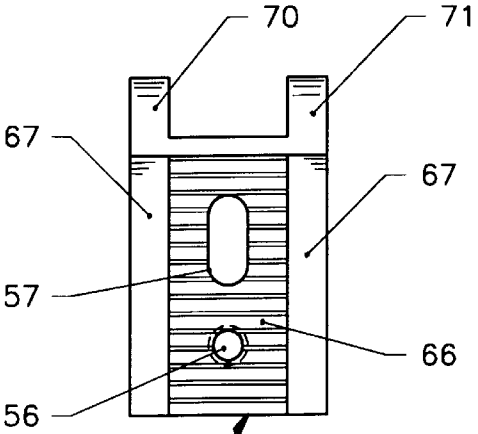
FIG. 5 is a side elevation view of a fixed jaw gripping surface insert.

Each of the inserts 51, 52 may be as wide (FIGS. 5 and 6) as the fixed jaw body 18, the width of which has to accommodate side wall structures of the fixed jaw body 18, on either side of the pinion 13 and the rack 21. However, the sides of the inserts 51, 52 which have teeth 59, 66 for engaging pipe may have sloped edges or tapers 67, thereby reducing the width of the teeth 59, 66, somewhat. The insert 52 may have a pair of curved ears 70, 71 which fit within corresponding arches 72, 73 in the side walls of fixed jaw body 18. This is for additional stability, but may be eliminated if desired. The flat gripping surfaces of the inserts 51, 52 may be the full width thereof, which is also the width of the fixed jaw body 18. Similarly, the ears, such as ear 62, on the sliding jaw 25 may extend out from the sides of the sliding jaw 25 so as to be the same width as the inserts 51, 52 and the fixed jaw body 18.

To prevent the sliding jaw 25 from becoming separated from the fixed jaw body 18, a pin 80 may pass through the rack 21 and extend past the walls 23, 24 of the sliding jaw 25 so as to engage the fixed jaw body 18 when the sliding jaw 25 is in its extreme leftmost position. If desired, the handle 11 may be tapered in one or more directions and may have a web 82 to provide clearance for the walls 23, 24 when the sliding jaw 25 is in its right-most (closed) position, or for aesthetic purposes.

The invention may be utilized with less than a full rack and a sector pinion. In fact, the invention may be used with a single tooth and a single recess on the lever 10 and sliding jaw 25, respectively or vice versa, if desired.

In operation, once the wrench is adjusted to the approximate size of the piece to be worked, the handle 11 will be rotated clockwise so as to slide the sliding jaw 25 to the right thereby gripping the piece being worked. Continued rotation in the clockwise direction will rotate the piece being worked in the clockwise direction. Thereafter, the handle can be turned in the counterclockwise direction, thus relaxing the grip on the piece being worked and repositioning the wrench for the next purchase, in a ratcheting fashion. Once again, rotation in the clockwise direction will cause the piece to be gripped and to be rotated in the clockwise direction, and so forth. Due to the design of the invention, with the pivot 14 tangential to the sliding surface 85 of the sliding jaw 25, the piece can be gripped in the extreme root of the jaws (up against the sliding surface 85 of the sliding jaw 25) without losing any gripping power. Therefore, ratcheting action (rocking the handle 11 back and forth) for successive purchases and rotation of the piece being worked, is very smooth. An important aspect of the invention is that the pivot 14 is as close as possible to the root of the jaws; that is, its upper edge is tangential to the sliding edge 85 of the sliding jaw 25. It cannot be any closer to the rack 21 without impeding the ability of the sliding jaw 25 to slide to the right and left shown. Because the pivot 14 is tangential to the sliding surface of the sliding jaw 25, which edge is also the root of the jaw as the piece is being gripped, any size piece can be gripped very firmly with a wrench of the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A lever wrench for use with pipes, fittings, nuts and bolts comprising: a hollow body having a rear portion, two side walls and a face portion between an end of said side walls opposite said rear portion, a stationary jaw having a first gripping surface removably mounted to said face portion, a lever pivotally secured at one of its ends to said body at said end of said side walls, said lever having at least one tooth thereon at said end adjacent to the pivotal connection to said side walls, a moveable jaw having a slider portion and a jaw portion with a second gripping surface facing the first gripping surface of said stationary jaw, said slider portion received between said walls of said body and having at least one recess to receive said at least one tooth of said lever such that pivotal movement of said lever will cause sliding movement of said moveable jaw toward or away from said stationary jaw, and a distance plate slidably mounted at the rear of said body between said rear portion and said slider portion, whereby when said distance plate is mounted on the wrench, said at least one recess of said slider is engaged with said at least one tooth and removal of said distance plate allows rapid adjustment or replacement of said moveable jaw.

2. A lever wrench according to claim 1 wherein said first and second gripping surfaces are perpendicular to the slider.

3. A lever wrench according to claim 1 wherein both said lever and said slider have a plurality of teeth and recesses, respectively.

4. A lever wrench according to claim 3 wherein said slider teeth have a height, said distance plate having a working section extending into said body and a height of said working section at least equaling the height of said teeth, and said distance plate having a collar of a larger size than said working section to allow grasping by a user.

5. A lever wrench according to claim 1 wherein said first and second gripping surfaces are smooth.

6. A lever wrench according to claim 1 wherein said first and second gripping surfaces are toothed.

7. A lever wrench according to claim 1 wherein said first and second gripping surfaces are smooth and form a right angle with respect to the slider.

8. A gear wrench comprising:

a hollow fixed jaw body having a fixed jaw portion and a rear portion, said portions joined by side walls, thereby forming a cavity;

a sliding jaw slidable in said cavity between said rear portion and said fixed jaw portion and having a rack disposed thereon;

a lever having a handle at one end and a sector pinion gear on the other end, said other end being pivotally disposed to said side walls within said cavity coaxially with said pinion gear, the teeth of said pinion gear facing the teeth of said rack; and a rigid spacer mounted between said rear portion and said sliding jaw, said space being movable between a stable working position in which said sliding jaw is positioned with its teeth intermeshing the teeth of said pinion, whereby pivotal movement of said lever will cause sliding movement of said sliding jaw toward or away from said fixed jaw, and a stable non-working position in which said sliding jaw can be disposed with its teeth disengaged from said pinion thereby to adjust the relative position of said sliding jaw with respect to said fixed jaw, whereby to adjust the working size of said wrench.

9. A wrench according to claim 8 including selectively operable means to latch said spacer in said working position.

10. A gear wrench comprising:

a hollow fixed jaw body having a fixed jaw portion and a rear portion, said portions joined by side walls, thereby forming a cavity;

a sliding jaw having a rack disposed thereon and slidable in said cavity between said rear portion and said fixed jaw portion, said sliding jaw having a sliding surface which slides against said body; and a lever having a handle at one end and a sector pinion gear on the other end, said other end being pivotally disposed to said side walls within said cavity coaxially with said pinion gear, said lever being disposed to said body by means of a pivot which is tangential to said sliding surface, the teeth of said pinion gear intermeshing with the teeth of said rack, whereby rotation of said handle causes motion of said sliding jaw toward or away from said fixed jaw portion.

11. A wrench according to claim 10 further comprising:

a spring operable between said sliding jaw and said fixed jaw body for urging relative rotation of said lever with respect to said sliding jaw in a direction to cause said sliding jaw to move closer to said fixed jaw portion, thereby to provide for ratcheting action.

12. A gear wrench comprising:

a hollow fixed jaw body having a fixed jaw portion including a first jaw surface and a rear portion, said portions joined by side walls, thereby forming a cavity;

a sliding jaw having a rack disposed thereon and slidable in said cavity between said rear portion and said fixed jaw portion including a second jaw surface generally facing said first jaw surface, said sliding jaw having a sliding surface which slides against said body, said sliding jaw having a pair of tabs rigidly disposed thereon adjacent respective edges of said second jaw surface, each tab having a force resisting surface substantially parallel to said sliding surface;

a lever having a handle at one end and a sector pinion gear on the other end, said other end being pivotally disposed to said side walls within said cavity coaxially with said pinion gear, the teeth of said pinion gear intermeshing with the teeth of said rack, whereby rotation of said handle causes motion of said sliding jaw toward or away from said fixed jaw; and a pair of gripping surface inserts, one for each of said fixed jaw and said sliding jaw, each of said inserts having teeth on one gripping surface thereof and being flat on a surface thereof opposite said one gripping surface, each being removably secured to the corresponding jaw with the teeth or the flat surfaces facing the other of said inserts, a first one of said inserts, corresponding with said sliding jaw, having a pair of tabs, each having a force transmitting surface which, when said insert is secured to said sliding jaw with the teeth thereof facing said other insert, is substantially parallel with said sliding surface and in contact with a corresponding one of said force resisting surfaces, thereby to resist tendency of said first insert to slide along said second jaw surface as a result of reactive forces on said teeth when applying torque to an object with said wrench.

13. A gear wrench comprising:

a hollow fixed jaw body having a fixed jaw portion including a first jaw surface and a rear portion, said portions joined by side walls, thereby forming a cavity;

a sliding jaw having a rack disposed thereon slidable in said cavity between said rear portion and said fixed jaw portion including a second jaw surface generally facing said first jaw surface, said sliding jaw having a sliding surface which slides against said body, said sliding jaw having a pair of tabs rigidly disposed thereon adjacent respective edges of said second jaw surface, each tab having a force resisting surface substantially parallel to said sliding surface; and a lever having a handle at one end and a sector pinion gear on the other end, said other end being pivotally disposed to said side walls within said cavity coaxially with said pinion gear, said lever being disposed to said body by means of a pivot which is tangential to said sliding surface, the teeth of said pinion gear facing the teeth of said rack;

a spacer mounted between said rear portion and said sliding jaw, said space being movable between a working position in which said sliding jaw is positioned with its teeth intermeshing the teeth of said pinion, whereby pivotal movement of said lever will cause sliding movement of said second jaw surface toward or away from said first jaw surface, and a non-working position in which said sliding jaw can be disposed with its teeth disengaged from said pinion thereby to adjust the relative position of said second jaw surface with respect to said first jaw surface, whereby to adjust the working size of said wrench;

a pair of gripping surface inserts, one for each of said fixed jaw and said sliding jaw, each of said inserts has teeth on one gripping surface thereof and is flat on a surface thereof opposite said one gripping surface, each being removably secured to the corresponding jaw with the teeth or the flat surfaces facing the other of said inserts, a first one of said inserts, corresponding with said sliding jaw, having a pair of tabs, each having a force transmitting surface which, when said insert is secured to said sliding jaw with the teeth thereof facing said other insert, is substantially parallel with said sliding surface and in contact with a corresponding one of said force resisting surface, thereby to resist tendency of said first insert to slide along said second jaw surface as a result of reactive forces on said teeth when applying torque to an object with said wrench.

14. A wrench according to claim 13 including selectively operable means to latch said spacer in said working position.

15. A wrench according to claim 13 further comprising:

a spring operable between said sliding jaw and said fixed jaw body for urging relative rotation of said lever with respect to said sliding jaw in a direction to cause said sliding jaw to move closer to said fixed jaw portion, thereby to provide for ratcheting action.

* * * * *